US008431516B2

(12) United States Patent
Lee

(10) Patent No.: US 8,431,516 B2
(45) Date of Patent: Apr. 30, 2013

(54) COMPOSITION AND METHOD FOR CLEANING SEMICONDUCTOR SUBSTRATES COMPRISING AN ALKYL DIPHOSPHONIC ACID

(76) Inventor: Wai Mun Lee, Milpitas, CA (US)

( * ) Notice: Subject to any disclaimer, the term of this patent is extended or adjusted under 35 U.S.C. 154(b) by 0 days.

(21) Appl. No.: 13/358,543

(22) Filed: Jan. 26, 2012

(65) Prior Publication Data

US 2012/0129345 A1 May 24, 2012

Related U.S. Application Data

(63) Continuation-in-part of application No. 12/888,569, filed on Sep. 23, 2010, now Pat. No. 8,148, 310.

(60) Provisional application No. 61/254,669, filed on Oct. 24, 2009.

(51) Int. Cl.
*C11D 7/36* (2006.01)

(52) U.S. Cl.
USPC ..... 510/175; 510/222; 510/228; 510/253; 510/254; 510/258; 510/431; 510/436; 510/467; 134/1.2; 134/1.3

(58) Field of Classification Search ..... 510/175, 510/222, 228, 253, 254, 258, 431, 436, 467; 134/1.2, 1.3
See application file for complete search history.

(56) References Cited

U.S. PATENT DOCUMENTS

| | | | | |
|---|---|---|---|---|
| 4,711,724 | A | 12/1987 | Johnson | |
| 4,802,990 | A * | 2/1989 | Inskeep, Jr. | 210/699 |
| 4,806,259 | A | 2/1989 | Amjad | |
| 5,635,167 | A | 6/1997 | Said et al. | |
| 6,143,705 | A | 11/2000 | Kakizawa | |
| 6,310,019 | B1 | 10/2001 | Kakizawa | |
| 6,395,693 | B1 | 5/2002 | Wang | |
| 6,410,494 | B2 | 6/2002 | Kakizawa et al. | |
| 6,440,856 | B1 | 8/2002 | Bessho | |
| 6,514,921 | B1 | 2/2003 | Kakizawa | |
| 6,534,458 | B1 | 3/2003 | Kakizawa | |
| 6,541,434 | B2 | 4/2003 | Wang | |
| 6,716,803 | B2 | 4/2004 | Kakizawa et al. | |
| 7,250,391 | B2 | 7/2007 | Kanno | |
| 7,265,005 | B2 | 9/2007 | Nowak et al. | |
| 7,312,186 | B2 | 12/2007 | Takashima | |
| 7,396,806 | B2 | 7/2008 | Sakai et al. | |
| 7,541,322 | B2 | 6/2009 | Ikemoto | |
| 2001/0051597 | A1 | 12/2001 | Kato et al. | |
| 2003/0078178 | A1 | 4/2003 | Ramirez et al. | |
| 2004/0161933 | A1 | 8/2004 | Takashima et al. | |
| 2005/0090104 | A1 | 4/2005 | Yang et al. | |
| 2005/0250661 | A1 | 11/2005 | Bragulla | |
| 2006/0276366 | A1 | 12/2006 | Deljosevic et al. | |
| 2006/0293199 | A1 | 12/2006 | Tamura et al. | |
| 2007/0090094 | A1 | 4/2007 | Thompson | |
| 2008/0039356 | A1 * | 2/2008 | Palmer et al. | 510/424 |
| 2009/0099051 | A1 | 4/2009 | Aoyama et al. | |
| 2009/0133716 | A1 | 5/2009 | Lee | |
| 2010/0216315 | A1 * | 8/2010 | Yaguchi et al. | 438/745 |
| 2011/0065622 | A1 | 3/2011 | Lee et al. | |

* cited by examiner

*Primary Examiner* — Charles Boyer

(57) ABSTRACT

The compositions and methods for the removal of residues and contaminants from metal or dielectric surfaces comprises at least one alkyl diphosphonic acid, at least one second acidic substance at a mole ratio of about 1:1 to about 10:1 in water, and pH is adjusted to from about 6 to about 10 with a metal ion free base, and a surfactant. Particularly, a composition and method of cleaning residues after chemical mechanical polishing of a copper or aluminum surface of the semiconductor substrates.

19 Claims, No Drawings

COMPOSITION AND METHOD FOR CLEANING SEMICONDUCTOR SUBSTRATES COMPRISING AN ALKYL DIPHOSPHONIC ACID

CROSS-REFERENCE TO RELATED APPLICATIONS

The present application is continuation-in-part of application Ser. No. 12/888,569 filed Sep. 23, 2010, and claims priorities from U.S. Provisional Appl. No. 61/254,669, filed Oct. 24, 2009, and are incorporated herein by reference in its entirety.

FIELD OF THE INVENTION

The present invention relates to compositions and methods for removal of chemical residues from metal or dielectric surfaces or for chemical mechanical polishing of a copper or aluminum surface including an aqueous solution comprising an alkyl disphosphonic acid compound applied for a time sufficient to remove the chemical residues.

BACKGROUND OF THE INVENTION

U.S. Pat. Nos. 6,143,705, 6,310,019, 6,440,856, 6,514,352, 6,514,921, 6,534,458, 6,541,434, 6,716,803, 7,250,391, 7,265,005, 7,312,186, and 7,541,322 discuss various compositions and methods of cleaning semiconductor substrates containing phosphonic acids.

U.S. Pat. Nos. 6,395,693 and 6,541,434 describe a method and composition for cleaning contaminants from the surface of a semiconductor wafer after the semiconductor wafer has been chemically-mechanically polished, the method comprising contacting the surface of the semiconductor wafer having abrasive particle and metal ion contaminants with a composition comprising carboxylic acid is present in an amount of about 2 wt. % or less, said amine-containing compound is present in an amount of about 0.1 wt. % or less, and said phosphonic acid is present in an amount of about, 2 wt. % or less. The cleaning composition desirably has a pH of about 4-6. Preferably, the cleaning composition has a pH of about 4.5-5.5. The weight ratio of phosphonic acid to carboxylic acid is 1:1.

U.S Patent Application No. 20010051597 discusses an aqueous solution of a citric acid concentration of more than 1 vol %, and the chelating, agent is added into the aqueous solution containing the citric acid by 10 ppm or more. The weight ratio of phosphonic acid to carboxylic acid, such is 1:1000 (i.e 10 ppm of phosphonic acid to 1% citric acid)

Phosphonic acid, in particular 1-hydroxyethane 1,1-diphosphonic acid (commonly termed HEDPA) has been in commercial use for many years as a corrosion inhibitor and as a complex agent. It is well understood when HEDPA is used in quantities less than 30 parts to million parts water, it acts as corrosion inhibitor. Above 150 parts to million parts water, it acts as a chelating agent. In the range 30-150 parts HEDPA to one million parts water there is a dead zone; the HEDPA does not perform.

It is known that HEDPA combined with a surfactant produces a synergistic result. The surfactant not only functions as a dispersant but also improves the residue dissolving performance of the HEDPA when the HEDPA is used in strength above 150 parts to million parts water.

SUMMARY OF THE INVENTION

The present invention relates to composition and method for cleaning semiconductor substrates. The invention has particular application as a residues and particles remover in semiconductor manufacturing processes and the like.

One embodiment encompassed is a cleaning solution that contains, an alkyl diphosphonic acid (component a) of the basic structure;

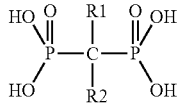

wherein R1 and R2 are either the same or different and select from the group consisting of hydrogen (H), hydroxide (OH), chloride (Cl), alkyl or aryl having between 1 to about 8 carbon atoms and alkyl or aryl amine. Some compositions contain a second acidic compound (component b), a buffering amount of one or more basic compounds (component c) to adjust pH from about 6 to about 1.0, optionally from 0% by weight and up to 5% by weight of a surfactant (component d), and a balance of water (component e).

The compositions encompassed may have a mole ratio of alkyl diphosphonic acid to a second acidic compound, or compounds, of about 1:1 to about 10:1.

The cleaning solution comprises from about 1% to about 50% by weight of the alkyl disphosphonic acid.

Preferred alkyl disphosphonic acids are 1 hydroxyethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane, 1,1 diphosphonic acid, 1-hydroxy-4-aminobutane 1,1 diphosphonic acid, and the like.

Where the composition contains a second acid, that second acid may, for example, be phosphonic acid, sulfonic acid, methanesulfonic acid, benzenesulfonic acid, dodecylbenzenesulfonic acid, xylenesulfonic acid, toluenesulfonic acid, phosphono formic acid, sulfamic acid, 2-amino ethane sulfonic acid, fluoro boric acid, phosphoric acid, hydrofluoric acid, aminotris(methylenephosphonic acid), N carboxymethylaminomethanephosphonic acid, carboxylic acid or mixtures thereof.

The composition may also contain an organic carboxylic acid. Where the composition contains an organic carboxylic acid, that acid may be aspartic acid, adipic acid, oxalic acid, lactic acid, citric acid, formic acid, tartaric acid, propionic acid, benzoic acid, ascorbic acid, gluconic acid, malic acid, malonic acid, succinic acid, gallic acid, butyric acid, trifluoracetic acid, hydroxy acetic acid, iminodiacetic acid and the like.

It is also contemplated that the compositions may include buffering basic compounds, such as potassium hydroxide, sodium hydroxide and metal ion free base. Where the compositions contain such a compound or mixture of compounds.

The metal ion free basic compound or mixture may be at least one basic compounds consisting of hydroxylamine freebase or a hydroxylamine derivative, tetraalkylammonium hydroxide, TMAH pentahydrate, BTMAH (benzyltetramethylammonium hydroxide), TBAH, choline, or THEMAH (Tris(2-hydroxyethyl)methylammonium hydroxide)), monoethanolamine, 2-(2-hydroxylethylamino)ethanol, 2-(2-aminoethoxy)ethanol, N,N,N-tris(2-hydroxyethyl)-ammonia, isopropanolamine, 3-amino-1-propanol, 2-amino-1-propanol, 2-(N-methylamino)ethanol, 2-(2-aminoethylamino) ethanol, tris(hydroxymethyl)aminoethane, or mixtures thereof.

A preferred pH range is from about 6 to about 10.

Surfactants may also be used in the compositions encompassed herein. Preferred surfactants include nonionic, anionic, cationic, and/or amphoteric, polyaspartic acid, polyacrylic acid or its water-soluble salts, or hydrolyzed polymaleic anhydride or its water soluble salts and the like.

In some applications the compositions may be diluted with DI water at dilution ratios, for example, of up to 1:10, up to 1:50, up to 1:100, up to 1:150, up to 1:250, and up to about 1:500 or any ratios therein.

One method of using the compositions described herein involves providing a substrate having a surface comprising copper-containing conductor and a low-k dielectric material and one or more of etching residue, planarization residue, and copper oxide disposed on the surface, which generated from a damascene or dual damascene manufacturing processes or thereof; contacting the surface of the substrate with an effective amount of solution comprising alley diphosphonic acid of the basic structure:

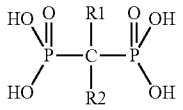

wherein R1 and R2 are either the same or different and select from the group consisting of hydrogen (H), hydroxide (OH), chloride (Cl), alkyl or aryl having between 1 to about 8 carbon atoms and alkyl or aryl amine, adding a second acidic compound and a buffering amount of basic compounds to adjust pH from about 6 to about 10, optionally including from 0% by weight and up to 5% by weight of a surfactant, with a balance of water. This composition is contacted with a substrate for a time and at a temperature sufficient to remove the resist, residues, and/or copper oxide. The preferred temperature for the method is from about ambient to about 70° C., more preferably about 50° C., and the preferred contact time is between about 10 seconds and about 10 minutes. The compositions described herein may be used in a cleaning process following a chemical mechanical planarization step during the semiconductor fabrication process, as well as other appropriate cleaning processes known to one of skill in the art.

DETAILED DESCRIPTION OF THE INVENTION

The present invention relates to the provision of an improved cleaning solution which is a blend of alkyl diphosphonic acid and a second acidic substance at a mole ratio of about 1:1 to about 10:1 in water.

The alkyl diphosphonic acid of the basic structure:

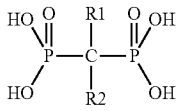

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine.

Non limiting examples of the alkyl diphosphonic acids are as follow:

| Name | R1 | R2 | Structure |
|---|---|---|---|
| -hydroxyethane 1, 1-diphosphonic acid | OH | $CH_3$ | 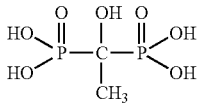 |
| methylene diphosphonic acid (MDP) | H | H | 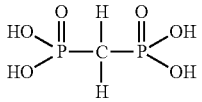 |
| Hydroxymethylene diphosphonic acid (HMDP) | OH | H | 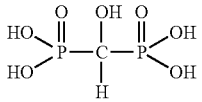 |
| Dichloromethylene diphosphonic acid ($Cl_2MDP$) | Cl | Cl | 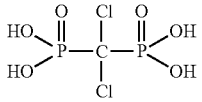 |
| Hydroxycyclo-hexylmethylene diphosphonic acid (HCMDP) | OH | 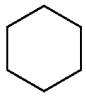 | 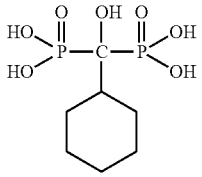 |
| 1-hydroxy-3 aminopropane 1,1-diphosphonic acid (APD) | OH | $—CH_2CH_2NH_2$ | 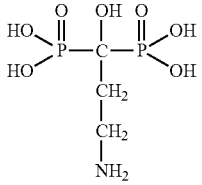 |
| 1-hydroxy-4-aminobutane 1,1 diphosphonic acid | OH | $—CH_2CH_2CH_2NH_2$ | 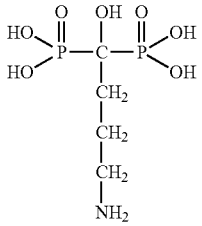 |

In accordance with the invention, from 1 mole to 10 moles of alkyl diphosphonic acid are mixed with one mole of second acidic substances.

Suitable alkyl diphosphonic acids include, but not limited to, 1 hydroxy ethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane 1,1 diphosphonic acid, 1-hydroxy-4-aminobutane 1,1 diphosphonic acid, and the like.

Suitable second acidic substances include phosphonic acid, sulfonic acid, methanesulfonic acid, benzenesulfonic acid, dodecylbenzenesulfonic acid, xylenesulfonic acid, toluenesulfonic acid, phosphono formic acid, sulfamic acid, 2-amino ethane sulfonic acid, fluoro boric acid, phosphoric acid, hydrofluoric acid, aminotris(methylenephosphonic acid), N carboxymethylaminomethanephosphonic acid, carboxylic acid, or mixtures thereof.

Non limiting examples of suitable carboxylic acid include aspartic acid, adipic acid, oxalic acid, lactic acid, citric acid, formic acid, tartaric acid, propionic acid, benzoic acid, ascorbic acid, gluconic acid, malic acid, malonic acid, succinic acid, gallic acid, butyric acid, trifluoracetic acid, hydroxy acetic acid, iminodiacetic acid and the like.

The mixture or blend is adjusted to a pH of about 6 to about 10 with a buffering amount of basic compounds, such as potassium hydroxide, sodium hydroxide and metal ion free basic compounds consisting of an ammonium compound, such as e.g. ammonium hydroxide, tetraalkylammonium hydroxide, TMAH pentahydrate, BTMAH (benzyltetramethylammonium hydroxide), TBAH, choline, or THEMAH (Tris(2-hydroxyethyl)methylammonium hydroxide)), hydroxylamine freebase, a hydroxylamine derivative, such as e.g N,N diethylhydroxylamine, an, alkanolamine component including but not limited to hydrazine, ethylenediamine, monoethanolamine, N,N diethylamino ethanol, 2-(2-hydroxylethylamino)ethanol, 2-(2-aminoethoxy)ethanol, N,N,N-tris(2-hydroxyethyl)-ammonia, isopropanolamine, 3-amino-1-propanol, 2-amino-1-propanol, 2-(N-methylamino)ethanol, 2-(2-aminoethylamino)ethanol, tris(hydroxymethyl)aminoethane, or mixtures thereof.

In one embodiment, the cleaning solution comprises from about 1% to about 50% by weight of at least one alkyl disphosphonic acid.

In another embodiment, the at least one alkyl diphosphonic acid may be present in solution in the amount from about 25% to about 50% by weight.

In another embodiment, at least two alkyl diphosphonic acids may be present in solution.

In another embodiment, at least one or more second acidic compound may be present in solution.

In another embodiment, the at least one or more second acidic compound may be present in solution in the amount from about 0.05% to about 50% by weight.

In another embodiment, the preferred second acidic compound is sulfamic acid.

The basic buffering agent may be present in an amount up to about 25% by weight.

Preferably the pH is from about 6 to about 10.

EXAMPLES

Example 1

The following is a list of blends prepared for the purpose of conducting tests:

| Composition | 1000 Gram quantities | Mol Wt | Mole | Solute Mole | Solute Gram | Wt % |
|---|---|---|---|---|---|---|
| 1 | 1-hydroxy ethanediphosphonic acid | 206 | 6 | 0.69 | 142.1 | 14.21% |
| | Dodecylbenzene sulfonic acid | 326.5 | 1 | 0.115 | 37.55 | 3.75% |
| | 25% TMAH adjust to pH 6 | | | | — | |
| | water | | | | Bal | |
| | Total | | | | 1000 | |
| 2 | 1-hydroxy ethanediphosphonic acid | 206 | 6 | 0.69 | 142.1 | 14.21% |
| | phosphono formic acid | 128 | 1 | 0.115 | 14.72 | 1.47% |
| | 25% TMAH adjust to pH 7 | | | | — | |
| | water | | | | Bal | |
| | Total | | | | 1000 | |
| 3 | 1-hydroxy ethanediphosphonic acid | 206 | 6 | 0.69 | 142.1 | 14.21% |
| | Oxalic Acid | 90 | 1 | 0.115 | 10.35 | 1.04% |
| | 65% (Tris(2-hydroxyethyl)methylammonium hydroxide)) adjust to pH 9 | | | | — | |
| | water | | | | Bal | |
| | Total | | | | 1000 | |
| 4 | 1-hydroxy ethanediphosphonic acid | 206 | 6 | 0.69 | 142.1 | 14.21% |
| | Sulfamic acid | 97 | 1 | 0.115 | 11.16 | 1.12% |
| | 45% Choline Hydroxide adjust to pH 9 | | | | — | |
| | water | | | | Bal | |
| | Total | | | | 1000 | |
| 5 | 1-hydroxy ethanediphosphonic acid | 206 | 6 | 0.69 | 142.1 | 14.21% |
| | Hydroxy acetic acid | 76 | 1 | 0.115 | 8.74 | 0.87% |
| | N,N diethylhydroxylamine/monoethanol amine (1:1 wt ratio) adjust pH to 7 | | | | — | |
| | water | | | | Bal | |
| | Total | | | | 1000 | |
| 6 | 1-hydroxy ethanediphosphonic acid | 206 | 6 | 0.69 | 142.1 | 14.21% |
| | Fluoro boric acid | 87.8 | 1 | 0.115 | 10.1 | 1.01% |
| | Ethylenene diamine adjust pH to 10 | | | | — | |
| | water | | | | Bal | |
| | Total | | | | 1000 | |
| 7 | 1-hydroxy ethanediphosphonic acid | 206 | 6 | 0.69 | 142.1 | 14.21% |
| | 2-amino ethane sulfonic acid | 14.5 | 1 | 0.115 | 1.668 | 0.17% |
| | 25% TMAH adjust to 7 | | | | — | |
| | water | | | | Bal | |
| | Total | | | | 1000 | |
| 8 | 1-hydroxy ethanediphosphonic acid | 206 | 6 | 0.3 | 61.8 | 6.18% |
| | hydroxy methylenephosphonic acid | 112 | | 0.3 | 33.6 | 3.36% |
| | Dodecylbenzene sulfonic acid | 326.5 | 1 | 0.1 | 32.65 | 3.27% |

-continued

| Composition | 1000 Gram quantities | Mol Wt | Mole | Solute Mole | Solute Gram | Wt % |
|---|---|---|---|---|---|---|
| | N,N diethylamino ethanol adjust pH to 7 | | | | — | |
| | water | | | | Bal | |
| | Total | | | | 1000 | |
| 9 | 1-hydroxy-3 aminopropane 1,1-diphosphonic acid | 235 | 6 | 1.2 | 282 | 28.20% |
| | Hydroxyacetic acid | 76 | 1 | 0.2 | 15.2 | 1.52% |
| | tris(hydroxymethyl)aminoethane adjust pH to 9 | | | | — | |
| | Water | | | | Bal | |
| | Total | | | | 1000 | |
| 10 | methylene disphosphonic acid | 176 | 6 | 0.69 | 121.4 | 12.10% |
| | 2-amino ethane sulfonic acid | 125 | 1 | 0.115 | 14.4 | 1.40% |
| | 28% ammonium hydroxide adjust pH to 7 | | | | — | |
| | Water | | | | Bal | |
| | Total | | | | 1000 | |
| 11 | 1-hydroxy ethanediphosphonic acid | 206 | 6 | 0.69 | 142.1 | 14.21% |
| | Citric acid | 192 | 1 | 0.115 | 22.08 | 2.21% |
| | 65% (Tris(2-hydroxyethyl)methylammonium hydroxide)) adjust to pH 9 | | | | — | |
| | water | | | | Bal | |
| | Total | | | | 1000 | |
| 12 | hydroxy methylenephosphonic acid | 112 | 6 | 0.6 | 67.2 | 6.72% |
| | Dodecylbenzene sulfonic acid | 326.5 | 1 | 0.1 | 32.65 | 3.27% |
| | 25% TMAH adjust pH to 10 | | | | — | |
| | water | | | | Bal | |
| | Total | | | | 1000 | |
| 13 | 1-hydroxy ethanediphosphonic acid | 206 | 6 | 0.69 | 142.1 | 14.21% |
| | Hydroxy acetic acid | 76 | 1 | 0.115 | 8.74 | 0.87% |
| | Potassium hydroxide adjust pH to 7 | | | | — | |
| | water | | | | Bal | |
| | Total | | | | 1000 | |
| 14 | 1-hydroxy ethanediphosphonic acid | 206 | 10 | 1.15 | 236.9 | 23.69% |
| | Sulfamic acid | 97 | 1 | 0.115 | 11.16 | 1.12% |
| | Potassium Hydroxide adjust to pH 7 | | | | — | |
| | water | | | | Bal | |
| | Total | | | | 1000 | |
| 15 | 1-hydroxy ethanediphosphonic acid | 206 | 3 | 0.345 | 71.07 | 7.11% |
| | Hydroxy acetic acid | 76 | 1 | 0.115 | 8.74 | 0.87% |
| | Potassium Hydroxide adjust pH to 7 | | | | — | |
| | water | | | | Bal | |
| | Total | | | | 1000 | |
| 16 | 1-hydroxy ethanediphosphonic acid | 206 | 3 | 0.345 | 71.07 | 7.11% |
| | Fluoro boric acid | 87.8 | 1 | 0.115 | 10.1 | 1.01% |
| | Potassium hydroxide adjust pH to 10 | | | | — | |
| | water | | | | Bal | |
| | Total | | | | 1000 | |
| 17 | 1-hydroxy ethanediphosphonic acid | 206 | 1 | 0.115 | 23.69 | 2.37% |
| | 2-amino ethane sulfonic acid | 14.5 | 1 | 0.115 | 1.668 | 0.17% |
| | 25% TMAH adjust to 7 | | | | — | |
| | water | | | | Bal | |
| | Total | | | | 1000 | |
| 18 | 1-hydroxy ethanediphosphonic acid | 206 | 4 | 0.4 | 82.4 | 8.24% |
| | hydroxy methylenephosphonic acid | 112 | 4 | 0.4 | 44.8 | 4.48% |
| | Dodecylbenzene sulfonic acid | 326.5 | 1 | 0.1 | 32.65 | 3.27% |
| | 65% (Tris(2-hydroxyethyl)methylammonium hydroxide)) adjust to pH 9 | | | | — | |
| | water | | | | Bal | |
| | Total | | | | 1000 | |
| 19 | 1-hydroxy ethanediphosphonic acid | 206 | 8 | 0.92 | 189.5 | 18.95% |
| | phosphono formic acid | 128 | 1 | 0.115 | 14.72 | 1.47% |
| | 25% TMAH adjust to pH 7 | | | | — | |
| | water | | | | Bal | |
| | Total | | | | 1000 | |
| 20 | 1-hydroxy ethanediphosphonic acid | 206 | 8 | 0.92 | 189.5 | 18.95% |
| | Oxalic Acid | 90 | 1 | 0.115 | 10.35 | 1.04% |

-continued

| Composition | 1000 Gram quantities | Mol Wt | Mole | Solute Mole | Solute Gram | Wt % |
|---|---|---|---|---|---|---|
| | 65% (Tris(2-hydroxyethyl)methylammonium hydroxide)) adjust to pH 9 | | | | — | |
| | water | | | | Bal | |
| | Total | | | | 1000 | |
| 21 | hydroxy methylenediphosphonic acid | 192 | 1 | 0.1 | 19.2 | 1.92% |
| | Dodecylbenzene sulfonic acid | 326.5 | 1 | 0.1 | 32.65 | 3.27% |
| | 25% TMAH adjust pH to 10 | | | | — | |
| | water | | | | Bal | |
| | Total | | | | 1000 | |
| 22 | 1-hydroxy ethanediphosphonic acid | 206 | 6 | 0.69 | 142.1 | 14.21% |
| | Sulfamic acid | 97 | 1 | 0.115 | 11.16 | 1.12% |
| | 45% Choline Hydroxide adjust to pH 9 | | | | — | |
| | water | | | | Bal | |
| | Total | | | | 1000 | |
| 23 | 1-hydroxy ethanediphosphonic acid | 206 | 1 | 0.50 | 103 | 10.3% |
| | Sulfamic acid | 97 | 1 | 0.50 | 48.5 | 4.85% |
| | 45% Choline Hydroxide adjust to pH 9 | | | | — | |
| | water | | | | Bal | |
| | Total | | | | 1000 | |
| 24 | 1-hydroxy ethanediphosphonic acid | 206 | 10 | 1.15 | 236.9 | 23.69% |
| | Sulfamic acid | 97 | 1 | 0.115 | 11.16 | 1.12% |
| | Potassium Hydroxide adjust to pH 7 | | | | — | |
| | water | | | | Bal | |
| | Total | | | | 1000 | |
| 25 | 1-hydroxy ethanediphosphonic acid | 206 | 10 | 0.03 | 6.18 | 6.18% |
| | Sulfamic acid | 97 | 1 | 0.003 | 0.29 | 0.29% |
| | Potassium Hydroxide adjust to pH 7 | | | | — | |
| | water | | | | Bal | |
| | Total | | | | 1000 | |
| 26 | 1-hydroxy-3 aminopropane 1,1-diphosphonic acid | 235 | 6 | 1.2 | 282 | 28.20% |
| | Sulfamic acid | 97 | 1 | 0.2 | 19.4 | 1.94% |
| | tris(hydroxymethyl)aminoethane adjust pH to 9 | | | | — | |
| | Water | | | | Bal | |
| | Total | | | | 1000 | |
| 27 | 1-hydroxy-3 aminopropane 1,1-diphosphonic acid | 235 | 10 | 1.2 | 282 | 28.20% |
| | Sulfamic acid | 97 | 1 | 0.12 | 11.64 | 1.16% |
| | tris(hydroxymethyl)aminoethane adjust pH to 9 | | | | — | |
| | Water | | | | Bal | |
| | Total | | | | 1000 | |
| 28 | 1-hydroxy-3 aminopropane 1,1-diphosphonic acid | 235 | 1 | 1.2 | 282 | 28.20% |
| | Sulfamic acid | 97 | 1 | 1.2 | 116.4 | 11.64% |
| | tris(hydroxymethyl)aminoethane adjust pH to 9 | | | | — | |
| | Water | | | | Bal | |
| | Total | | | | 1000 | |

This example illustrates the significance of the mole ratio of alkyl phosphonic acid to second acidic component in the cleaning composition of the present invention in reducing slurry particle remnants and metal ion remnants on the surface of a substrate.

Silicon oxide wafers were immersed for 30 seconds with copper-contaminated slurry. The oxide wafers were then washed with each of the above listed compositions and followed by rinsing in DI water. There was a complete and relatively fast dissolution of the remnants. Each of the blends removed the slurry particle remnants and metal ion from the surface of the substrates without attacking the exposed metal surfaces.

Example 2

The procedure was repeated with 5 parts of Composition 9 in 100 parts of D.I water (1:20 water dilution). Effectively, this solution contains 1.343% of 1-hydroxy-3 aminopropane 1,1-diphosphonic acid and 0.122% of hydroxyacetic acid. It still maintains a 6:1 mole ratio of alky diphosphonic to second acidic compound. The same results were obtained by the use of this mixture.

Example 3

The procedure was repeated with 1 parts of Composition 5 in 100 parts of D.I water (1:100 wafer dilutions). Effectively, this solution contains 0.141% of 1-hydroxy ethanediphosphonic acid and 0.009% of hydroxyacetic acid. It still maintains 6:1 mole ratio of alky diphosphonic to second acidic compound. The same results were obtained by the use of this mixture.

Example 4

The procedure was repeated with 1 parts of Composition 15 in 100 parts of D.I water (1:100 water dilutions). Effectively, this solution contains 0.0711% of 1-hydroxy ethanediphosphonic acid and 0.009% of hydroxyacetic acid. It still maintains 3:1 mole ratio of alky diphosphonic to second acidic compound. The same results were obtained by the use of this mixture.

Example 5

The procedure was repeated with 5 parts of Composition 14 in 100 parts of D.I water (1:20 water dilution). Effectively, this solution contains 1.185% of 1-hydroxy ethanediphosphonic acid and 0.056% of sulfamic acid. It still maintains a 10:1 mole ratio of alky diphosphonic to second acidic compound. The same results were obtained by the use of this mixture.

Example 6

| Ingredients | Trade name/ product name | Supplier | Wt (Grams) | % |
|---|---|---|---|---|
| 1-hydroxy ethane-diphosphonic acid CAS#2809-21-4 | DEQUEST 2010 | Thermphos | 580 | 13.0% |
| Hydroxy acetic acid | Glycolic Acid | Du Pont | 60 | 1.3% |
| Hydroxylamine Freebase (50%) | | San Fu | 600 | 13.4% |

-continued

| Ingredients | Trade name/ product name | Supplier | Wt (Grams) | % |
|---|---|---|---|---|
| Triethanolamine (85%) | TEA85 | Dow | 470 | 10.5% |
| water | | | 2760 | 61.7% |
| Total | | | 4470 | 100.0% |

The pH of the above solution is 7.24-7.26. The solution can be used as is or further diluted with water if necessary.

Example 7

| Ingredients | Trade name/ product name | Supplier | Wt (Grams) | % |
|---|---|---|---|---|
| 1-hydroxy ethane-diphosphonic acid CAS#2809-21-4 | DEQUEST 2010 | Thermphos | 530 | 11.2% |
| Amino tris (methylene phosphonic acid) in water CAS#6419-19-8 | DEQUEST 2000 | Thermphos | 90 | 1.9% |
| N,N Diethyl-hydroxylamine 85% CAS#3710-84-7 | | Arkema | 310 | 6.6% |
| Monoethanolamine | MEA | Dow | 310 | 6.6% |
| water | | | 3480 | 73.7% |
| Total | | | 4420 | 100.0% |

The solution is 7.7. The solution can be used as is or further diluted with water if desired.

Examples 8

| Composition | 1000 Gram quantities | Mol Wt | Mol | Solute Mole | Solute Gram | Wt % |
|---|---|---|---|---|---|---|
| 1 | 1-hydroxy ethanediphosphonic acid | 206 | 6 | 1.26 | 259.6 | 25.96% |
| | Oxalic Acid | 90 | 1 | 0.21 | 18.9 | 1.89% |
| | 65% (Tris(2-hydroxyethyl)methylammonium hydroxide)) adjust to pH 9 | | | | — | |
| | water | | | | Bal | |
| | Total | | | | 1000 | |
| 2 | 1-hydroxy ethanediphosphonic acid | 206 | 6 | 1.5 | 309 | 30.90% |
| | Hydroxy acetic acid | 76 | 1 | 0.25 | 19 | 1.90% |
| | N,N diethylhydroxylamine/monoethanol amine (1:1 wt ratio) adjust pH to 7 | | | | — | |
| | water | | | | Bal | |
| | Total | | | | 1000 | |
| 3 | 1-hydroxy-3 aminopropane 1,1-diphosphonic acid | 235 | 6 | 1.2 | 282 | 28.20% |
| | Hydroxyacetic acid | 76 | 1 | 0.2 | 15.2 | 1.52% |
| | tris(hydroxymethyl)aminoethane adjust pH to 9 | | | | — | |
| | Water | | | | Bal | |
| | Total | | | | 1000 | |
| 4 | 1-hydroxy ethanediphosphonic acid | 206 | 6 | 1.32 | 271.9 | 27.19% |
| | Citric acid | 192 | 1 | 0.22 | 42.24 | 4.22% |
| | 65% (Tris(2-hydroxyethyl)methylammonium hydroxide)) adjust to pH 9 | | | | — | |
| | water | | | | Bal | |
| | Total | | | | 1000 | |
| 5 | 1-hydroxy ethanediphosphonic acid | 206 | 6 | 1.8 | 370.8 | 37.08% |
| | Hydroxy acetic acid | 76 | 1 | 0.3 | 22.8 | 2.28% |

-continued

| Composition | 1000 Gram quantities | Mol Wt | Mol | Solute Mole | Solute Gram | Wt % |
|---|---|---|---|---|---|---|
| | Potassium hydroxide adjust pH to 7 | | | | — | |
| | water | | | | Bal | |
| | Total | | | | 1000 | |
| 6 | 1-hydroxyethanediphosphonic acid | 206 | 3 | 1.5 | 309 | 30.90% |
| | Hydroxy acetic acid | 76 | 1 | 0.5 | 38 | 3.80% |
| | Potassium Hydroxide adjust pH to 7 | | | | — | |
| | water | | | | Bal | |
| | Total | | | | 1000 | |
| 7 | 1-hydroxy ethanediphosphonic acid | 206 | 8 | 1.6 | 329.6 | 32.96% |
| | Oxalic Acid | 90 | 1 | 0.2 | 18 | 1.80% |
| | 65% (Tris(2-hydroxyethyl)methylammonium hydroxide)) adjust to pH 9 | | | | — | |
| | water | | | | Bal | |
| | Total | | | | 1000 | |
| 8 | 1-hydroxy ethanediphosphonic acid | 206 | 1 | 1.26 | 259.6 | 25.96% |
| | Oxalic Acid | 90 | 1 | 1.26 | 113.4 | 11.34% |
| | 65% (Tris(2-hydroxyethyl)methylammonium hydroxide)) adjust to pH 9 | | | | — | |
| | water | | | | Bal | |
| | Total | | | | 1000 | |
| 9 | hydroxy methylene diphosphonic acid | 192 | 1 | 1.5 | 288 | 28.8 |
| | Dodecylbenzene sulfonic acid | 326.5 | 1 | 1.5 | 489.75 | 49 |
| | 25% TMAH adjust pH to 6 | | | | — | |
| | water | | | | Bal | |
| | Total | | | | 1000 | |

It will be obvious to any skill in the art that the effectiveness of removing particle and metal ion contaminant will depend on the seriousness of the problem. A higher concentration of the blended composition will produce faster results.

The composition of the invention does not sequest and there is no dead or non-performance zone of cleaning.

The alky diphosphonic acid acts as a chelating agent throughout a large concentration range, starting with a few parts to million parts water.

In another embodiment, the composition contains a surfactant which enhance the cleaning performance of the composition over the composition with alkyl diphosphonic acid alone.

Preferably a surfactant is admixed with the blend to both keep it from re-precipitating and to enhance the cleaning ability of the composition. There are several types of surfactants available. Readily available and relatively inexpensive surfactants include anionic, cationic, non-ionic, amphoteric, polyaspartic acid, polyacrylic acid, water-soluble salts of polyacrylic acid, hydrolyzed poly-maleic anhydride, or water-soluble salts of polyacrylic acid.

While the invention has been described and illustrated herein by reference to various specific materials, procedures and examples, it is understood that the invention is not restricted to the particular combinations of materials and procedures selected for that purpose. Numerous variations of such details can be implied as will be appreciated by those skilled in the art. It is intended that me specification and examples considered as exemplary, only, with the true scope and spirit of the invention being indicated by the following claims. All references, patents, patent applications referred to in this application are herein being incorporated by reference in their entirety.

What is claimed is:

1. A cleaning solution comprises a. greater than 6% by weight of an alkyl diphosphonic acid of the basic structure:

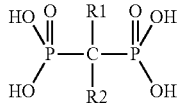

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine;

b. sulfamic acid;

c. a buffering amount of one or more metal ion free basic compounds selected from the group consisting of hydroxylamine freebase, a hydroxylamine derivative, tetraalkylammonium hydroxide, TMAH pentahydrate, BTMAH (benzyltetramethylammonium hydroxide), TBAH, choline, THEMAH (Tris(2-hydroxyethyl)methylammonium hydroxide)), monoethanolamine, 2-(2-hydroxylethylamino)ethanol, 2-(2-aminoethoxy)ethanol, N,N,N-tris(2-hydroxyethyl)-ammonia, isopropanolamine, 3-amino-1-propanol, 2-amino-1-propanol, 2-(N-methylamino)ethanol, 2-(2-aminoethylamino)ethanol, tris(hydroxymethyl)aminoethane, or mixtures thereof;

d. from 0% by weight and up to 5% by weight of a surfactant; and e. water.

2. The composition according to claim 1 wherein the mole ratio of alkyl diphosphonic acid to sulfamic acid is from about 1:1 to about 10:1.

3. The composition according to claim 1 in which the alkyl disphosphonic is 1 hydroxyethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane 1,1 diphosphonic acid, 1-hydroxy-4-aminobutane 1,1 diphosphonic acid or mixtures thereof.

4. The composition according to claim 1, wherein the aqueous solution comprises about 0.05 wt % to about 50 wt % of sulfamic acid.

5. The composition according to claim 1 further comprises an acidic compound is selected from the group consisting of phosphonic acid, sulfonic acid, methanesulfonic acid, benzenesulfonic acid, dodecylbenzenesulfonic acid, xylenesulfonic acid, toluenesulfonic acid, phosphono formic acid, 2-amino ethane sulfonic acid, fluoro boric acid, phosphoric acid, hydrofluoric acid, aminotris(methylenephosphonic acid), N carboxymethylaminomethanephosphonic acid, aspartic acid, adipic acid, oxalic acid, lactic acid, citric acid, formic acid, tartaric acid, propionic acid, benzoic acid, ascorbic acid, gluconic acid, malic acid, malonic acid, succinic acid, gallic acid, butyric acid, trifluoracetic acid, hydroxy acetic acid, iminodiacetic acid or mixtures thereof.

6. The composition according to claim 1 further comprising an additional buffering base selected from the group consisting of potassium hydroxide, sodium hydroxide or mixtures thereof.

7. The composition according to claim 1 has a pH from about 6 to about 10.

8. The composition according to claim 1 wherein the surfactants include anionic, cationic, non-ionic, amphoteric, polyaspartic acid, polyacrylic acid, water-soluble salts of polyacrylic acid, hydrolyzed poly-maleic anhydride, water-soluble salts of polyacrylic acid or mixture thereof.

9. A method of cleaning semiconductor substrates comprising the steps of:

i. providing a substrate having a surface comprising copper-containing conductor and a low-k dielectric material and one or more of etching residue, planarization residue, and copper oxide disposed on the surface, which generated from a damascene or dual damascene manufacturing processes or thereof;

ii. contacting the surface of the substrate with an effective amount of solution comprising:

a. greater than 6% by weight of an alkyl diphosphonic acid of the basic structure:

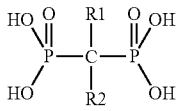

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine;

b. sulfamic acid;

c. a buffering amount of one or more basic compounds to adjust pH from about 6 to about 10;

d. from 0% by weight and up to 5% by weight of a surfactant; and e. water for a time and at a temperature sufficient to remove the resist, residues, and/or copper oxide.

10. The method of according to claim 9 wherein the mole ratio of alkyl diphosphonic acid to sulfamic acid is from about 1:1 to about 10:1.

11. The method according to claim 9 in which the alkyl disphosphonic is selected from the group consisting of 1 hydroxyethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane 1,1 diphosphonic acid, 1-hydroxy-4-aminobutane 1,1 diphosphonic acid or mixtures thereof.

12. The method according to claim 9, wherein the aqueous solution comprises about 0.05 wt % to about 50 wt % of sulfamic acid.

13. The method according to claim 9 further comprises acidic compound is selected from the group consisting of phosphonic acid, sulfonic acid, methanesulfonic acid, benzenesulfonic acid, dodecylbenzenesulfonic acid, xylenesulfonic acid, toluenesulfonic acid, phosphono formic acid, 2-amino ethane sulfonic acid, fluoro boric acid, phosphoric acid, hydrofluoric acid, aminotris(methylenephosphonic acid), N carboxymethylaminomethanephosphonic acid, aspartic acid, adipic acid, oxalic acid, lactic acid, citric acid, formic acid, tartaric acid, propionic acid, benzoic acid, ascorbic acid, gluconic acid, malic acid, malonic acid, succinic acid, gallic acid, butyric acid, trifluoracetic acid, hydroxy acetic acid, iminodiacetic acid or mixtures thereof.

14. The method according to claim 9 in which the buffering base is selected from potassium hydroxide, sodium hydroxide, metal ion free base or mixture thereof.

15. The method according to claim 14 in which the buffering metal ion free base is selected from at least one basic compounds consisting of hydroxylamine freebase or a hydroxylamine derivative, tetraalkylammonium hydroxide, TMAH pentahydrate, BTMAH (benzyltetramethylammonium hydroxide), TBAH, choline, or THEMAH (Tris(2-hydroxyethyl)methylammonium hydroxide)), monoethanolamine, 2-(2-hydroxylethylamino)ethanol, 2-(2-aminoethoxy) ethanol, N,N,N-tris(2-hydroxyethyl)-ammonia, isopropanolamine, 3-amino-1-propanol, 2-amino-1-propanol, 2-(N-methylamino)ethanol, 2-(2-aminoethylamino) ethanol, tris(hydroxymethyl)aminoethane, or mixtures thereof.

16. The method according to claim 9, wherein the pH range is about 6 to about 8.

17. The method according to claim 9 wherein the surfactants include anionic, cationic, non-ionic, amphoteric, polyaspartic acid, polyacrylic acid, water-soluble salts of polyacrylic acid, hydrolyzed poly-maleic anhydride, water-soluble salts of polyaspartic acid or mixture thereof.

18. The method according to claim 9, wherein said composition is diluted with DI water at dilution ratio from at least 1:1 to about 1:500.

19. The method according to claim 9 wherein the cleaning process is following chemical mechanical planarization step during the semiconductor fabrication processes.

* * * * *